United States Patent [19]

Eng et al.

[11] 4,245,222

[45] Jan. 13, 1981

[54] DUAL FUNCTION ANTENNA

[75] Inventors: Edward Eng; Glen D. Gibbons, both of San Jose; David L. Thomas, Mountain View; John W. Tse, Sunnyvale, all of Calif.

[73] Assignee: The United States of America as represented by the Secretary of the Navy, Washington, D.C.

[21] Appl. No.: 942,859

[22] Filed: Sep. 15, 1978

[51] Int. Cl.[3] ..... H01Q 1/28

[52] U.S. Cl. ..... 343/708; 343/725; 343/770

[58] Field of Search ..... 343/705, 708, 789, 725, 343/767–770

[56] References Cited

U.S. PATENT DOCUMENTS

| | | | |
|---|---|---|---|
| 3,475,755 | 10/1969 | Bassen et al. | 343/705 |
| 3,518,683 | 6/1970 | Jones, Jr. | 343/705 |
| 3,550,141 | 12/1970 | Harris et al. | 343/767 |
| 3,569,971 | 3/1971 | Griffee | 343/853 |
| 3,573,834 | 10/1968 | McCabe | 343/769 |
| 3,701,161 | 10/1972 | Gregory | 343/770 |
| 3,739,386 | 6/1973 | Jones, Jr. | 343/708 |
| 3,810,183 | 5/1974 | Krutsinger et al. | 343/708 |
| 3,813,674 | 5/1974 | Sidford | 343/789 |
| 3,914,767 | 10/1975 | Jones, Jr. | 343/708 |

*Primary Examiner*—David K. Moore

*Attorney, Agent, or Firm*—R. S. Sciascia; Charles D. B. Curry; Francis I. Gray

[57] ABSTRACT

A dual function antenna operating at two frequency bands for both the radar fuzing function and the telemetry function with a single antenna cavity. A pair of flush-mounted, cavity-backed circumferential slots are located near the base of a missile body and are fed out-of-phase to produce an N=1 mode gain pattern with peaks at nose-on and aft aspects. Each slot is excited by a probe and tee-bar transition. A telemetry band trap circuit is incorporated into the radar band probe and tee-bar to isolate telemetry band energy. A single telemetry probe is inserted into the cavity and spaced apart from the radar probe to excite the antenna at telemetry frequencies.

4 Claims, 6 Drawing Figures

DUAL FUNCTION ANTENNA

BACKGROUND OF THE INVENTION

1. Field of the Invention.

The present invention relates to flush-mounted, cavity-backed slot antennas, and more particularly to a dual function antenna which operates in two frequency bands.

2. Description of the Prior Art

For testing and evaluation of aerospace re-entry bodies the capability for accommodating the telemetry function must be provided. Separate antenna systems were thus used—one for the radar function and one for the telemetry function. Since the operational re-entry body shells have a single antenna system, it was necessary to fabricate special shells with the additional telemetry antennas for testing and evaluation.

SUMMARY OF THE INVENTION

Accordingly, the present invention provides a dual function antenna operating at two frequency bands for both the radar function and the telemetry function with a single antenna cavity. A pair of flush-mounted, cavity-backed circumferential slots are located near the base of an aerospace re-entry body and are fed out-of-phase to produce an N=1 mode gain pattern with peaks at nose-on and aft aspects. The slots are electrically half-wave in length with their physical lengths reduced by the dielectric loading of the flush-mounted windows. Each slot is excited by a probe and tee-bar transition for the radar function. A telemetry band trap circuit is incorporated into the radar band probe and tee-bar to isolate telemetry band energy. A single feed probe for the telemetry function is inserted into the cavity and spaced apart from the radar band probe to excite the antenna at the telemetry band frequencies.

Therefore, it is an object of the present invention to provide a flush-mounted, cavity-backed circumferential slot antenna to operate at two frequency bands.

Another object of the present invention is to provide a single antenna system for both operational use and testing and evaluation with concomitant cost savings.

Other objects, advantages and novel features of the present invention will be apparent from the following detailed description when read in view of the appended claims and attached drawing.

DESCRIPTION OF THE PREFERRED EMBODIMENT

Figure 1:
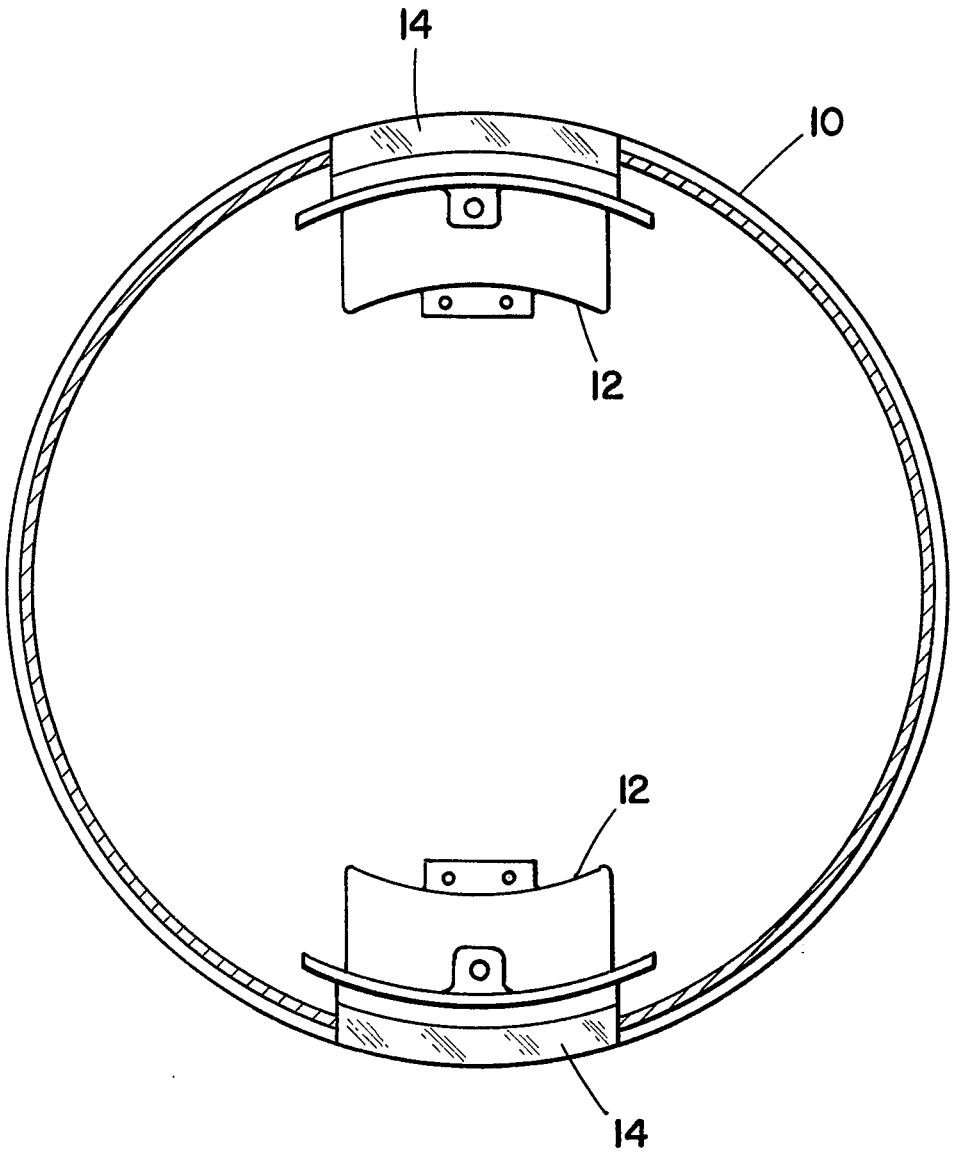
FIG. 1 is a cross-sectional view of an aerospace re-entry body showing the location of the pair of antennas according to the present invention.

Referring now to FIG. 1 an aerospace re-entry body shell 10, approximately in the shape of a cone, has two cavity antennas 12 located diametrically apart. The two cavity antennas 12 are mounted to the aerospace re-entry body such that the antenna windows 14 are flush with the surface of the missile re-entry body shell 10. The two cavity antennas 12 are in the form of circumferential slots.

Figure 2:
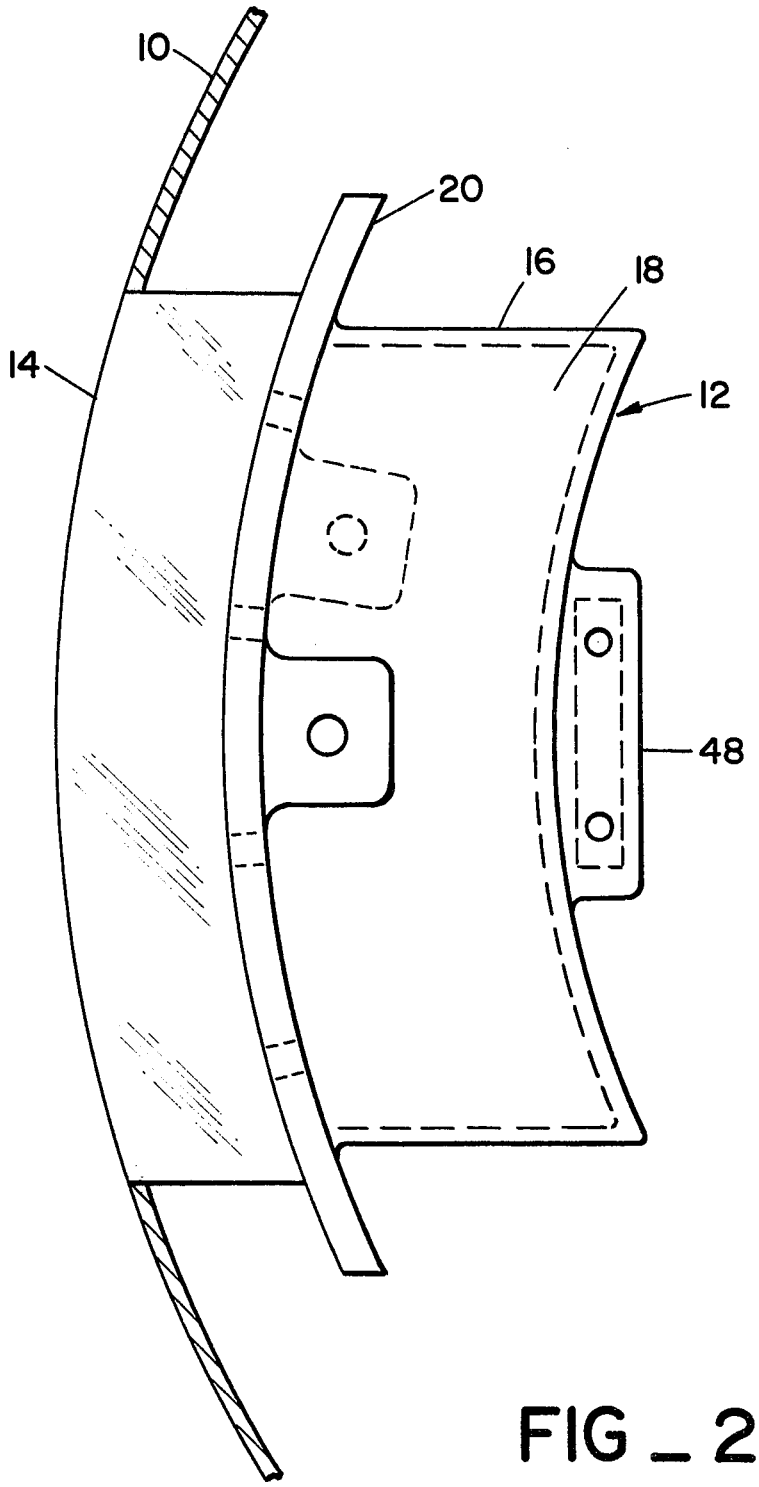
FIG. 2 is a side view of an antenna according to the present invention.
Figure 3:
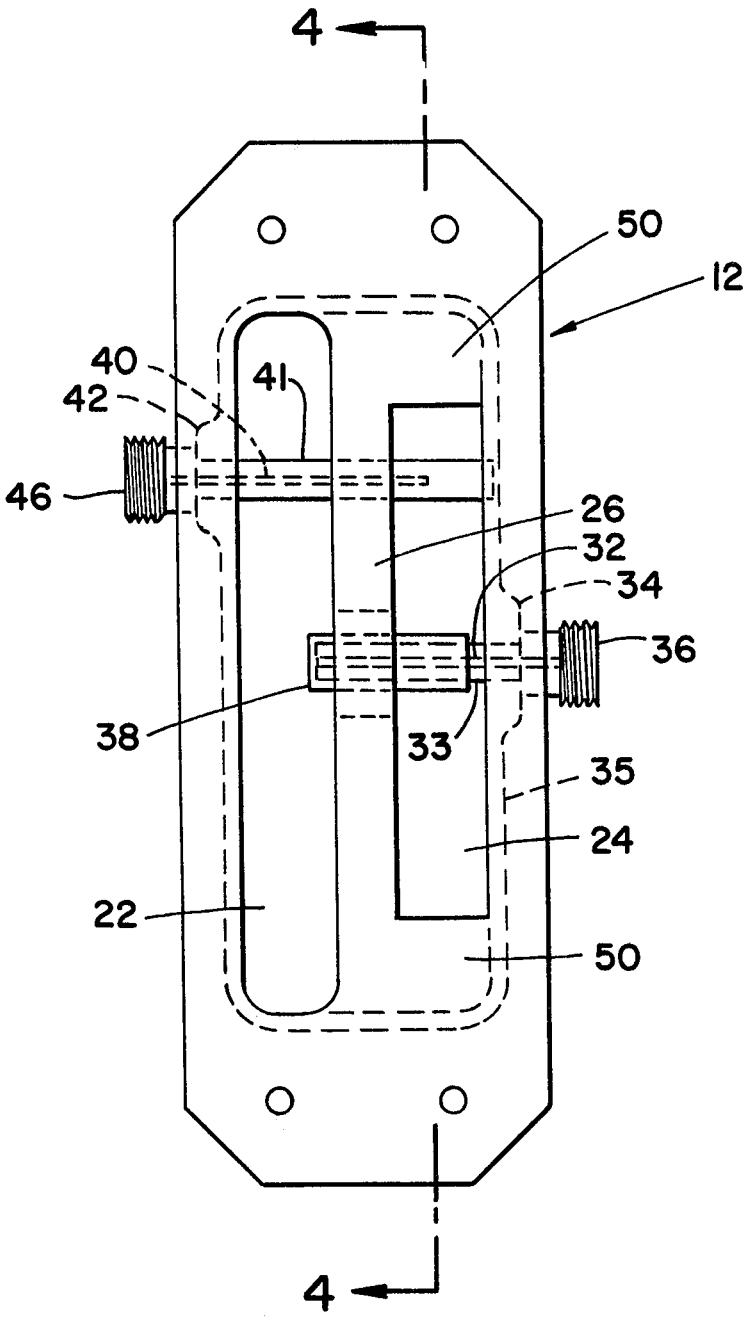
FIG. 3 is a top view of the antenna of FIG. 2 without the dielectric window.
Figure 4:
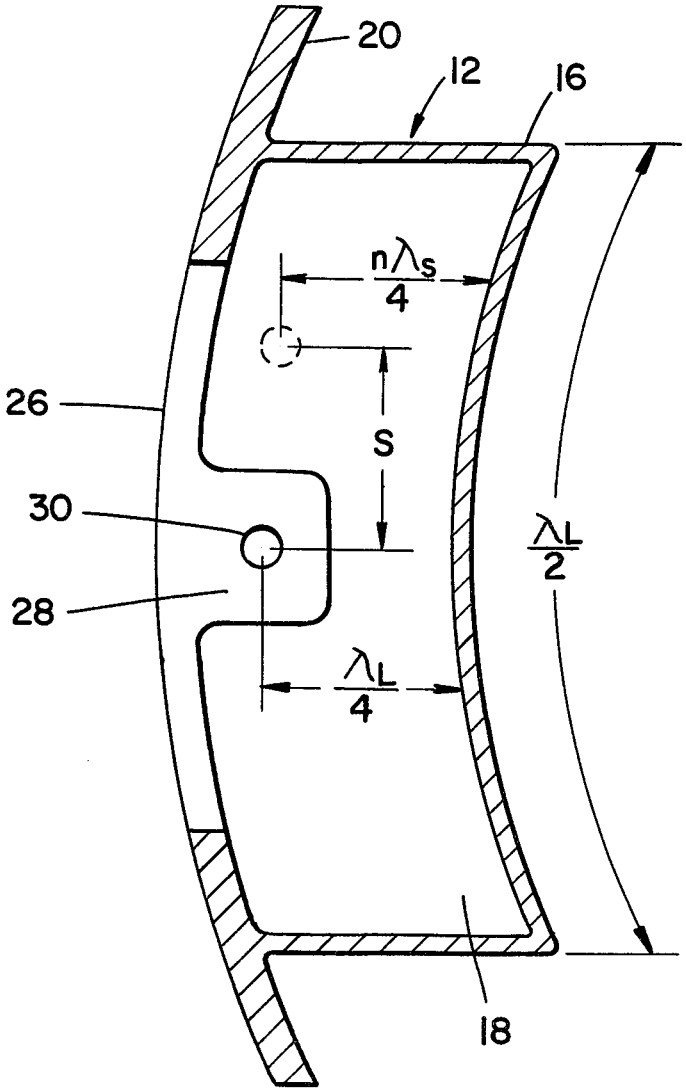
FIG. 4 is a cross-sectional view of the antenna of FIG. 3 taken along line 4—4.

A closer view of one of the cavity antennas 12 is shown in FIGS. 2–4. A thin-walled metal body 16 having sides and a back forms a resonating cavity 18. Integral with the body 16 is a metallic face 20 having two longitudinal parallel slots 22, 24 partially enclosing the open end of the cavity 18. One of the slots 24 is shorter than the other and the metallic end pieces 50 act as shunts to tune the antenna 12 for the best voltage standing wave ratio (VSWR) for the lower band frequency. The central member 26 of the metallic face 20 between the slots 22 and 24 has a flange 28 protruding into the cavity 18 with a hole 30 therethrough to form a tee-bar transition. A low-band probe 32 with a dielectric sleeve 33 is inserted into the cavity 18 through the tee-bar hole 30 and is connected via a port 34 integral with one outer wall 35 of the metal body 16 to an external connector 36 by which electrical energy is applied. A high-band trap circuit 38 in the form of a conductive sheath such as aluminum, which acts like a coaxial choke, surrounds the low-band probe 32 and sleeve 33 and contacts the central member 26, which is shorted at the sidewalls of the metal body 16, to isolate the high-band energy from the low-band source and to provide an acceptable impedance match over a frequency bandwidth of greater than 10%.

A single feed probe 40 with a dielectric sleeve 41 is inserted via a second input port 42 integral with the opposite outer wall 44 of the metal body 16 to extend through the cavity 18, and is encaptured by the first wall 35. An external connector 46 provides means for connecting to an electrical energy excitation source. The high-band probe 40 is located laterally at a distance S from the low-band probe 32, the distance S being selected for optimum impedance match, frequency isolation and bandwidth.

The cavity 18 is designed for the low-band operation, such as L-band radar; and the low-band probe 32 is positioned at the center of the cavity at a distance $\lambda_L/4$ from the back of the metal body 16, where $\lambda_L$ is the effective wavelength of the low-band center frequency. The length of the cavity 18 is $\lambda_L/2$. The high-band probe 40 excites a higher order mode in the same cavity, and is located at a distance of $\eta\lambda_H/4$ from the back of the metal body 16, where $\eta$ is the mode order and $\lambda_H$ is the effective wavelength of the high-band center frequency, such as for S-band telemetry. The use of the dielectric window 14 reduces the physical dimensions of the cavity 18 by approximately $1/\sqrt{\epsilon}$, where $\epsilon$ is the dielectric constant of the window.

Figure 5A:
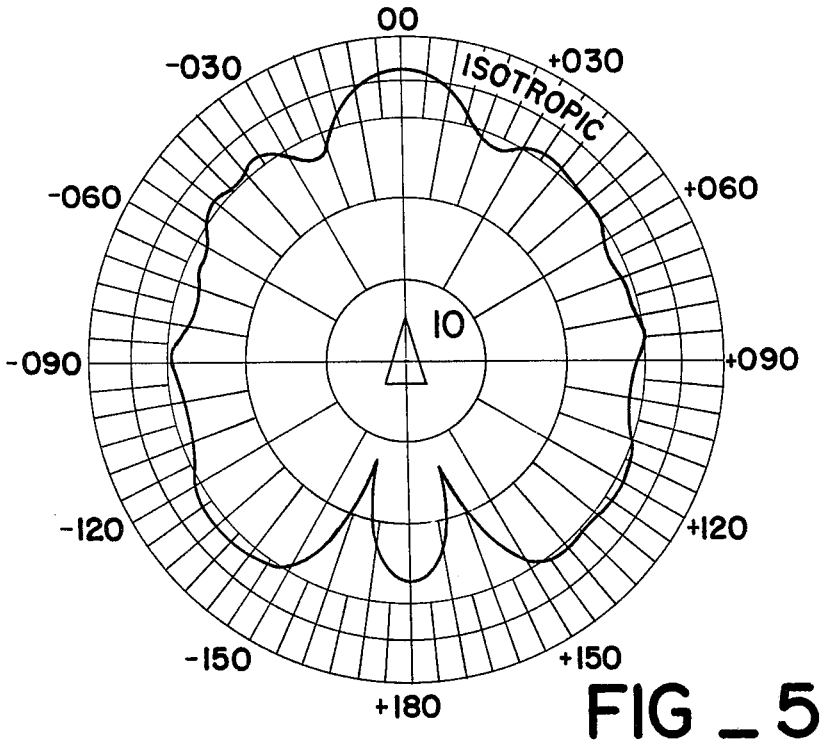
FIG. 5*a* is a diagrammatic view of the radar band antenna pattern in a plane through the aerospace re-entry body axis and the two antenna elements.
Figure 5B:
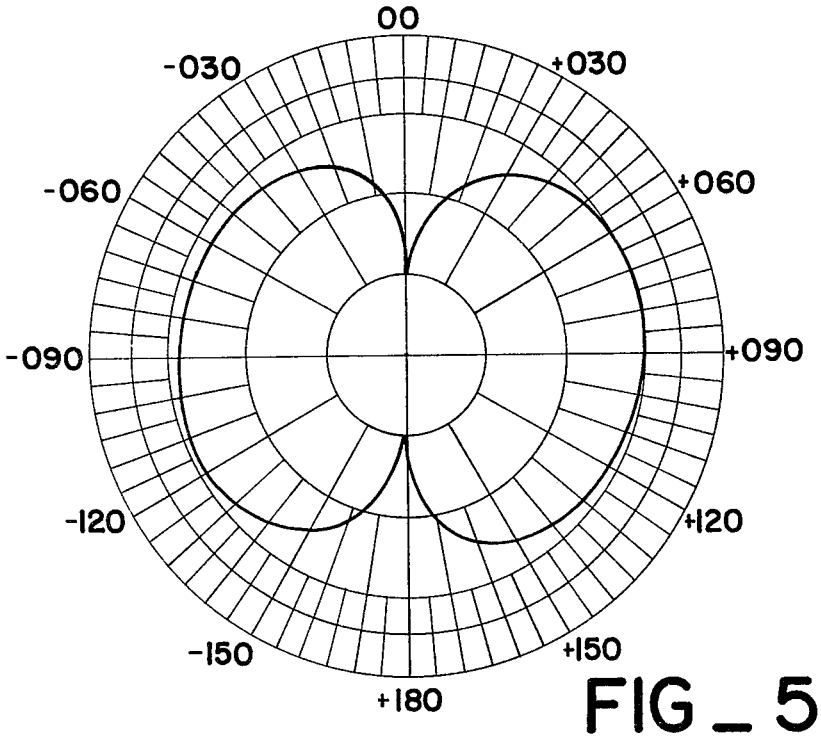
FIG. 5*b* is a diagrammatic view of the antenna pattern in a plane orthogonal to the aerospace re-entry body axis.

A power divider 48 mounted to the outside back of one of the antennas 12 provides the out-of-phase input to the two antennas. The result of the out-of-phase inputs is an antenna pattern as shown in FIGS. 5*a* and 5*b*. An N=1 mode pattern with peaks at nose-on and aft aspects is produced with dominant near nose-on, broadside and near aft radiation coverage for most vehicle roll angles. The two antennas 12 also serve to give adequate gain coverage about the roll axis of the spinning re-entry body shell 10.

Also, the high-band probe 40 can be diplexed or a third probe inserted into the cavity 18 to provide a third frequency band, such as C-band for the beacon tracking function.

Therefore, the present invention provides a low-band, flush-mounted cavity-backed circumferential half-wave slot antenna which also operates as a high-band antenna to eliminate the requirement of a second antenna for telemetry during testing and evaluation.

What is claimed is:

1. A dual function antenna system for a conical aerospace re-entry body comprising:

(a) a pair of flush-mounted, circumferential cavity-backed slot antennas located diametrically opposite each other near the base of said re-entry body;

(b) means for feeding said antennas out-of-phase to produce an a gain pattern with peaks at nose-on and aft aspects;

(c) first means inserted into said cavity to form a tee-bar transition for exciting said antenna at a low frequency; and (d) second means inserted in said cavity for exciting said cavity at a higher order mode, higher band frequency, said second means being separated from said first means.

2. A dual function antenna system for a conical aerospace re-entry vehicle comprising:

(a) a pair of flush-mounted, circumferential cavity-backed slot antennas located diametrically opposite each other near the base of said re-entry body, each of said antennas having (i) an approximately rectangular housing having a back and sides, (ii) a faceplate integral with and enclosing the front of said housing, said faceplate having a pair of parallel circumferential slots therein the length of said housing to form a slotted cavity and having a cross-bar separating said slots, (iii) a first probe inserted through one of the longitudinal sides of said housing at the midpoint and through a flange protruding into said slotted cavity to form a tee-bar transition such that when said first probe is electrically excited said cavity resonates at a low-band frequency, and (iv) a second probe inserted through the opposite longitudinal side of said housing from said first probe at a point laterally spaced from said first probe and extending to the longitudinal side of said first probe such that when said second probe is electrically excited said cavity resonates at a high-band frequency which is a harmonic of said low-band frequency;

(b) means for feeding said antennas out-of-phase to produce a gain pattern with peaks at nose-on and aft aspects; and (c) means for exciting each of said antennas at said low-band frequency and at said high-band frequency.

3. A dual function antenna system as recited in claim 2 wherein each of said antennas further comprises means for isolating the low-band source from high-band energy via said first probe.

4. A dual function antenna system as recited in claim 3 wherein said isolating means comprising a conductive sheath surrounding said first probe, said sheath being in contact with said cross-bar.

* * * * *